US005930989A

United States Patent [19]

Nakagawa et al.

[11] Patent Number: 5,930,989

[45] Date of Patent: Aug. 3, 1999

[54] FALSE TWISTED YARN

[75] Inventors: Masanori Nakagawa, Nagaokakyo; Hiroshi Uto, Ibaraki, both of Japan

[73] Assignees: Asahi Kasei Kogyo Kabushiki Kaisha, Osaka, Japan; Akzo Nobel Faser AG, Wuppertal, Germany

[21] Appl. No.: 09/051,195

[22] PCT Filed: Oct. 9, 1996

[86] PCT No.: PCT/JP96/02937

§ 371 Date: Apr. 3, 1998

§ 102(e) Date: Apr. 3, 1998

[87] PCT Pub. No.: WO97/13897

PCT Pub. Date: Apr. 17, 1997

[30] Foreign Application Priority Data

Oct. 11, 1995 [JP] Japan ..... 7-288123

[51] Int. Cl.[6] ..... D02G 3/02

[52] U.S. Cl. ..... 57/243; 57/247

[58] Field of Search ..... 57/243, 246, 247, 57/250, 284, 286, 292; 28/220, 247, 258, 281

[56] References Cited

U.S. PATENT DOCUMENTS

| | | | |
|---|---|---|---|
| 5,671,757 | 9/1997 | Woodings | 131/331 |
| 5,709,716 | 1/1998 | Taylor | 8/401 |

FOREIGN PATENT DOCUMENTS

| | | |
|---|---|---|
| 57-101006 | 6/1982 | Japan . |
| 2-41423 | 2/1990 | Japan . |
| 2-41428 | 2/1990 | Japan . |
| 6-306733 | 11/1994 | Japan . |

*Primary Examiner*—John J. Calvert
*Assistant Examiner*—Gina Silverio
*Attorney, Agent, or Firm*—Finnegan, Henderson, Farabow, Garrett & Dunner, L.L.P.

[57] ABSTRACT

A false twisted yarn is made from a lyocell multifilament yarn having a crimp shape coefficient defined by CE/N of 0.02–0.20, wherein CE is a crimp extension (%) and N is the number of crimps; a crimp extension of 0.7–7%; and a degree of swelling in water of 70% or less.

4 Claims, 2 Drawing Sheets

FALSE TWISTED YARN

TECHNICAL FIELD

The present invention relates to a bulky false twisted yarn.

More particularly, the present invention relates to a false twisted yarn with high bulkiness which is superior in crimp shape retention during dyeing and laundering and which is high in stretch recovery.

PRIOR ART

False twisted yarns made of a cellulose fiber are disclosed in JP-A-2-41423, JP-A-2-41428 and JP-A-6-306733. In JP-A-2-41423 and JP-A-2-41428, in particular, false twisted yarns made from a viscose rayon yarn and production processes therefor are disclosed. These false twisted yarns are superior in bulkiness; however, the fabrics made therefrom have problems, for example, in that when the fabrics are subjected to a wetting treatment such as dyeing or the like, or when the fabric products after dyeing are subjected to laundering, the crimp which has been given to the fabrics or fabric products disappears and thereby the bulkiness thereof disappears as well. Thus, fabrics made of conventional false twisted yarns are inferior in crimp shape retention, and it has been difficult to sufficiently utilize the features of the false twisted yarns in final fabric products made therefrom.

As a means for solving such problems, a technique is known for producing a false twisted yarn by mixing a cellulose fiber with a synthetic fiber such as polyester or the like, to allow the yarn to have good crimp shape retention.

However, the fabrics made of such a false twisted yarn produced by mixing a cellulose fiber with a synthetic fiber have problems in that they show a deterioration in touch of surface uniquely possessed by cellulose fiber, i.e., the dry touch possessed by cellulose fiber as compared to a waxy feel (a wax-like touch) possessed by many synthetic fibers, a reposeful and elegant luster similar to silk luster, and drape.

The above-mentioned JP-A-6-306733 mentions a lyocell multifilament yarn, which is a conjugated filament yarn, as an example of an easily fibrillatable fiber and discloses subjecting the yarn to false twisting using a high feed rate (i.e., a high rate of yarn feeding for false twisting). The technique relates to improving the feel of the fabric by subjecting a lyocell multifilament yarn to false twisting to generate fibrils from the yarn and thereby allowing the fabric produced from the resulting false twisted yarn to have a slimy feel (a mixed touch of the above-mentioned waxy feel and a slightly sticky touch). This false twisting at a high feed rate of lyocell multifilament yarn, however, is unable to achieve the bulkiness and crimp shape retainability under wet conditions, as intended by the present invention.

DISCLOSURE OF THE INVENTION

An object of the present invention is to provide a false twisted yarn which has excellent bulkiness and consequent bulging feeling, which has excellent crimp shape retainability even under wet conditions during dyeing, laundering, etc. and which has surface toughness and elegant luster both unique to cellulose fiber.

The present inventors eagerly made a study in an effort to provide a yarn having bulkiness and shape retainability under wet conditions during dyeing, laundering, etc. As a result, the present inventors found out that by allowing a lyocell fiber, which is a cellulose fiber, to have a controlled degree of swelling in water and subjecting the resulting lyocell fiber to false twisting so that the resulting false twisted yarn can have a particular crimp shape, there can be obtained a false twisted yarn superior in bulkiness and crimp shape retainability even under wet conditions. The present invention has been completed based on this finding.

The present invention lies in a false twisted yarn comprising a lyocell multifilament yarn having a crimp shape coefficient, defined by CE/N, of 0.02–0.20, wherein CE is a crimp extension (%) and N is the number of crimps; a crimp extension of 0.7–7%; and a degree of swelling in water of 70% or less.

BEST MODE FOR CARRYING OUT THE INVENTION

Figure 1:
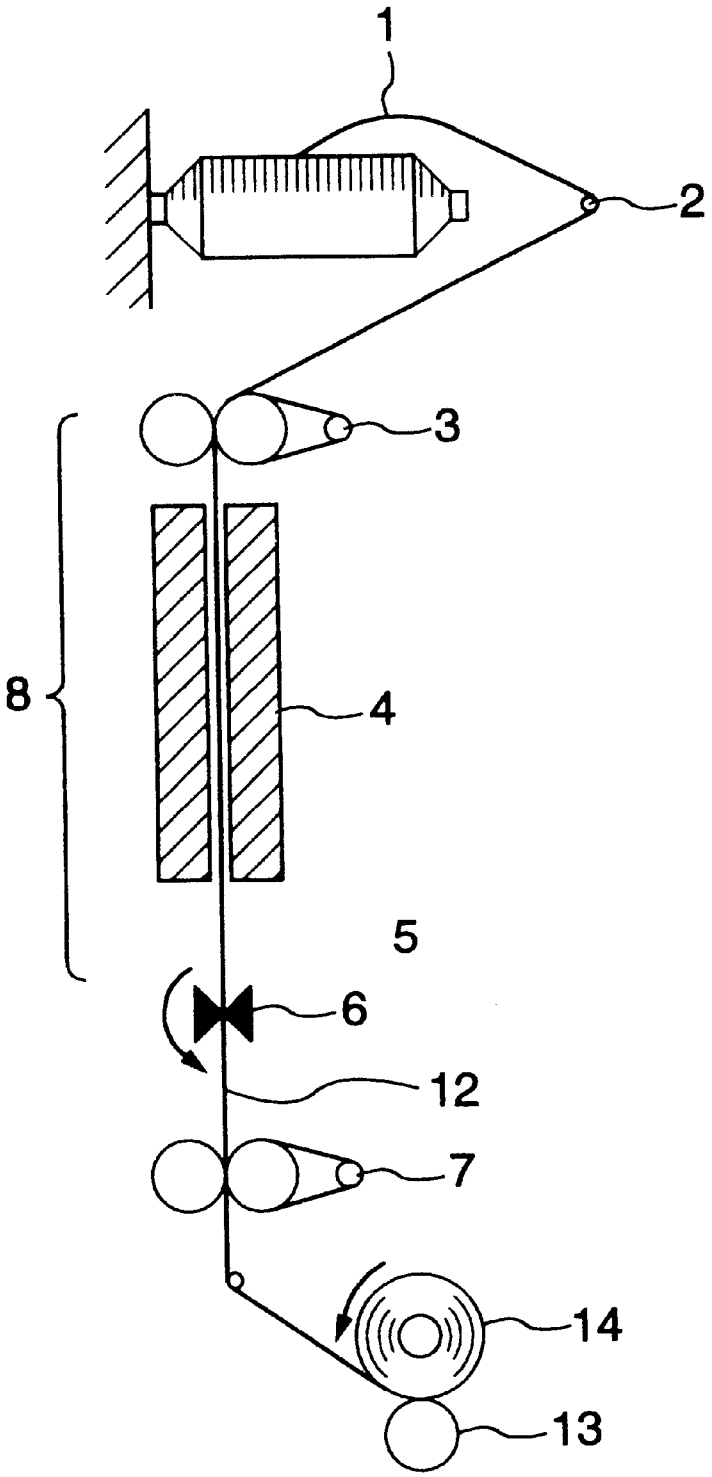
FIG. 1 shows a process for producing a false twisted yarn using a pin type false twisting machine.

The present invention is hereinafter described in more detail.

The false twisted yarn of the present invention is made of a lyocell multifilament yarn.

Lyocell multifilament yarn refers to a cellulose fiber obtained by organic solvent spinning. A lyocell multifilament yarn can be obtained as described in, for example, JP-B-60-28848, by spinning a solution containing a cellulose dissolved in an organic solvent and a non-solvent to the cellulose (e.g., water), into air or a non-precipitating medium; pulling the fiber-formable solution emitted from a spinneret at a speed larger than the feed speed to form a yarn at a draft ratio of 3 or more; and then treating the yarn in a non-solvent.

The organic solvent used for dissolving a cellulose may be a known organic solvent, for example, an amine oxide or other solvent.

The amine oxide used as the organic solvent includes, as disclosed in, for example, JP-B-60-28848, tertiary amine N-oxides such as trimethylamine N-oxide, triethylamine N-oxide, tripropylamine N-oxide, monomethyldiethylamine N-oxide, dimethylmonomethylamine N-oxide, monomethyldipropylamine N-oxide, N-dimethylcyclohexylamine N-oxide, N-diethylcyclohexylamine N-oxide, N-dipropylcyclohexylamine N-oxide and the like; pyridine N-oxide; and cyclic N-methylamine N-oxides such as N-methylmorpholine N-oxide and the like. The use of N-methylmorpholine N-oxide is particularly preferable.

The false twisted yarn made of a lyocell multifilament yarn according to the present invention has a degree of swelling in water of 70% or less. When the yarn has a degree of swelling in water exceeding 70%, the yarn is inferior in crimp shape retainability under wet conditions during dyeing, laundering, etc., which is not desirable. The degree of swelling in water is preferably 40–70%, and more preferably 50–65%.

The false twisted yarn of the present invention may comprise a fiber other than lyocell fiber as long as the object of the present invention is not impaired, but it preferably comprises a lyocell multifilament yarn in an amount of 80% or more, and more preferably 100%.

The crimp extension of a false twisted yarn comprising a lyocell multifilament yarn according to the present invention is a value (%) obtained by dividing the extension of a sample of a given length of the present false twisted yarn when a given load is applied thereto, by the given length of the sample before load application, and this value indicates the extensibility of the crimp possessed by the false twisted yarn. The number of crimps (N) is the number of crimps per inch of yarn length.

The crimp extension of the present false twisted yarn is 0.7–7%, and preferably 1.0–5.0%. When the crimp extension is less than 0.7%, the crimp is too small, resulting in inferior bulkiness. When the crimp extension exceeds 7%, the crimp is too large, resulting in impairment of the luster and feel both unique to cellulose fiber.

The false twisted yarn of the present invention is high in shape recovery of the crimp possessed by the yarn. The crimp possessed by the false twisted yarn desirably maintains its shape even after the yarn has been subjected to knitting or weaving and dyeing. The present false twisted yarn is small in recovery of stretch. The recovery of stretch indicates the shape recoverability of the crimp in hot water. If the recovery of stretch is smaller, the shape recoverability of the extended crimp is high.

In the false twisted yarn comprising a lyocell multifilament yarn, according to the present invention, the crimp shape coefficient is defined by a value obtained by dividing CE by N. The value is 0.02–0.20, and preferably 0.05–0.12. The crimp shape coefficient indicates the extension of the yarn per one crimp, i.e., the extensibility of the yarn. A larger crimp extension indicates a larger amplitude of crimp. Therefore, the crimp shape coefficient has a high correlation to the size of the crimp.

When the crimp shape coefficient is smaller than 0.02, the false twisted yarn is inferior in bulkiness. When the crimp shape coefficient is larger than 0.20, the false twisted yarn is deteriorated in the luster and feel possessed by cellulose fiber.

The false twisted yarn of the present invention preferably has a tenacity of 3–5 g/d (2.7–4.5 g/dtex) and an elongation of 5–12% in the absolute dry condition.

The denier value of the present false twisted yarn may be appropriately determined depending upon the intended application of the yarn. A preferable denier value is, for example, 1–3 d (as single-yarn denier) and about 50–150 d (as total denier). One denier (d) corresponds to 1.11 dtex.

The false twisted yarn of the present invention is subjected to knitting or weaving depending upon the application thereof. For knitting or weaving, the false twisted yarn of the present invention may be mixed with a natural cellulose fiber (e.g., cotton), a regenerated cellulose fiber, or a synthetic fiber (e.g., polyester) as long as the object of the present invention is not impaired. The fiber to be mixed may be appropriately selected depending upon the desired feel of the knitted or woven fabric to be obtained.

The structure of the knitted fabric produced may be any of T cloth, rib stitch, interlock stitch, half, power net, etc. The knitted fabric may be a warp knitted fabric such as tricot fabric, Raschel fabric, or the like, or a weft knitted fabric produced by weft knitting, circular knitting, or the like. The knitting gauge usable in the knitting is in a range of 12–36 GG (gauge).

The structure of the woven fabric may be any of plain, twill, satin, and derivative weaves thereof.

The fabric obtained by subjecting the present false twisted yarn to knitting or weaving is superior in bulkiness and consequently has a bulky thickness and bulging feeling when touched, and further has elegant luster such as possessed by silk.

Next, description is made of an example of the process for producing the present false twisted yarn.

The production of false twisted yarn comprises the three steps of twisting, heat setting, and untwisting. Herein, a production process using a pin type false twisting machine is explained with reference to FIG. 1.

A lyocell multifilament yarn 1 enters a feed roller 3 via a guide roll 2, passes through a false-twisting spindle 6 via a heater 4 and a cooling zone 5, is introduced into a delivery roller 7 via an untwisting zone 12, and is wound into a cheese 14 by a friction drum 13. The step from the feed roller 3 to the false-twisting spindle 6 is called the twisting step. The heater 4 provided in a twisting zone 8 carries out heat setting. That is, in the twisting zone 8, the yarn 1 is heated by the heater 4 and, in an easily deformable state, is endowed with twisting strain, and then is allowed to continue running while the yarn 1 is being cooled to fix the strain. The feed rate is controlled by the speed ratio of the feed roller 3 and the delivery roller 7.

The number of false twists is represented by:

$$(23{,}000/\sqrt{D}+590)\times 0.6\sim(23{,}000/D+590)\times 1.1$$

(wherein D is the total denier of the feed yarn). The temperature of false twisting is 110–250° C. The time of heating is 0.3–1.5 sec. The method of false twisting may be any of pin-false-twisting and friction-false-twisting.

In production of a false twisted yarn, the feed rate of material yarn to be subjected to false twisting is important. As mentioned above, the feed rate can be controlled by the speed ratio of the feed roller 3 which feeds the yarn 1 and the delivery roller 7 positioned downstream of the false twisting step. When the feed rate is too high (over-feeding), the yarn 1 is fed into the twisting zone 8 in a loop state and subjected to false twisting. Conversely, when the feed rate is too low (under-feeding), the yarn 1 is fed into the twisting zone 8 in a pulled state and subjected to false twisting. In production of the false twisted yarn of the present invention, the feed rate is set at 1–2%. In production of the present false twisted yarn using a lyocell multifilament yarn, it is very important to set the feed rate in the above range. A lyocell multifilament yarn, as compared with rayon, has a small elongation. Therefore, when the feed rate is set at a level lower than 1% (under-feeding), end breakage occurs easily; when the feed rate is set at a level higher than 2%, fluffs are easily generated from the yarn. Therefore, these feed rates are not preferred.

By selecting a feed rate at 1–2% in false twisting, a false twisted yarn of the present invention can be obtained which has a desired crimp shape and which is free from fluff.

The present invention is described below more specifically by way of Examples and Comparative Examples. However, the present invention is not restricted to these Examples alone.

In the following Examples, measurement of various properties were made as follows:

(1) Crimp extension (CE) (%):

Measured according to JIS L 1077–5.7 (stretchability).

(2) Number of crimps (N):

Measured according to JIS L 1074–6.11.1 (number of crimps).

(3) Degree of swelling in water (%):

$$[(B-A)/A]-100$$

wherein A is an absolute dry weight of a sample, and B is a sample weight after the sample is immersed in water of 20° C. for 30 minutes and then dehydrated using a centrifuge of 23 cm in diameter at 3,500 rpm for 5 minutes to remove the water adhering onto the sample surface.

Figure 2:
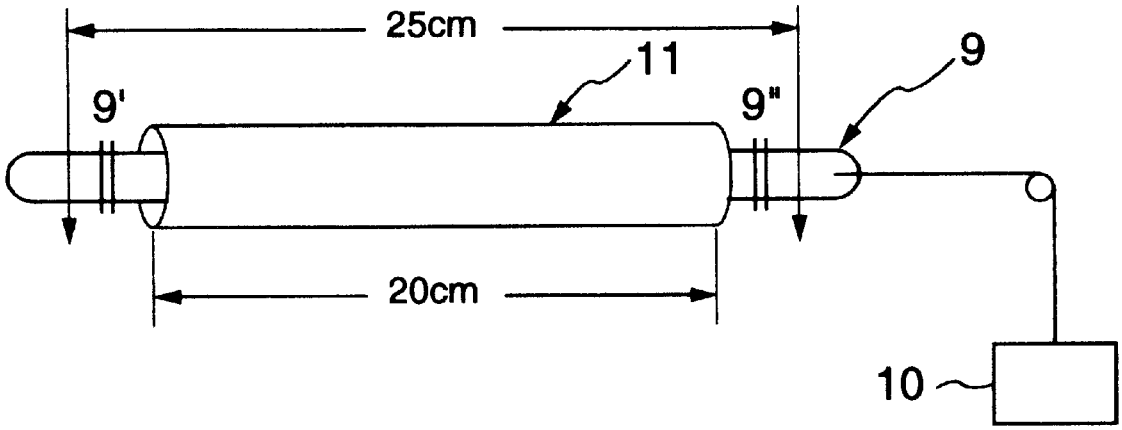
FIG. 2 is a figure for explaining a method for measuring stretch recovery.

(4) Stretch recovery (%):

Explanation is made referring to FIG. 2. A hank 9 is prepared so as to have a total denier of 2,800 d (3,108 dtex); a load 10 of 280 g is applied to the hank 9, and the hank 9 is inserted into a glass tube 11 of 20 cm in length; the hank 9 is fixed at two edge positions 9' and 9" and is cut so as to have a length of 25 cm; the resulting yarn bundle sample is subjected to a relaxing treatment together with the glass tube in a voile for 20 minutes; then, the sample, which has shrunk in the glass tube, is measured for length (a).

Stretch recovery (%)=(a/25)×100

(5) Tenacity and elongation of yarn:

Measured according to JIS-L-1013.

(6) Hand feel of the knitted fabric:

Hand feel of the knitted fabric by handling was examined by five examiners. The hand feel when three or more examiners felt bulkiness, was rated as "o"; and the hand feel when three or more examiners felt no bulkiness, was rated as "X".

(7) Appearance of knitted fabric:

Luster of the knitted fabric was examined visually under a standard light A by five examiners. Comparing with silk luster, the luster of the knitted fabric was rated as "o" when three or more examiners judged that the luster was close to silk luster; and the luster was rated as "X" when three or more examiners judged otherwise. There was used, as a silk for comparison, a silk-attached fabric meeting JIS-L-0813.

A lyocell multifilament yarn was produced as follows:

In accordance with the production process described in Example 1 of JP-B-60-28848, a pulp and an aqueous N-methylmorpholine N-oxide solution were placed in a mixing vessel and mixed under reduced pressure to obtain a cellulose solution having a cellulose concentration of 10.0%. The cellulose solution was subjected to air gap spinning at a discharging temperature of 124° C. under the conditions shown in Table 1. The spun yarn was water-washed for scouring, followed by drying and winding, to obtain a lyocell multifilament yarn of 75 d/50 f (83 dtex/50f) having the properties shown in Table 1.

EXAMPLES 1–3 AND COMPARATIVE EXAMPLES 1–2

The lyocell multifilament yarn (test yarn) produced under the conditions shown in Table 1 was subjected to false twisting (temperature=200° C., treating time=0.6 sec, yarn speed=100 m/min, feed rate=+1%, number of twists=1, 000–2,500 T/M) by the use of a pin type false twisting machine (a contact heater type having a heater length of 1 m, LS-2 produced by Mitsubishi Heavy Industries, Ltd.) to obtain false twisted yarns different in crimp shape coefficients (CE/N).

Using these false twisted yarns, T cloth circular knitted fabrics each of 28 GG were produced and subjected to dyeing according to an ordinary method. The resulting knitted fabrics were examined to determine their properties, and the results are shown in Table 2.

COMPARATIVE EXAMPLES 3–4

A viscose rayon multifilament yarn of [75d/33f (=83 dtex/33f)] was used in place of the lyocell multifilament yarn and was subjected to false twisting under the same conditions as in Examples 2 and 3. Using the resulting false twisted yarns, circular knitted fabrics were obtained in the same manner as in Example 1 and subjected to dyeing according to an ordinary method. The resulting knitted fabrics were examined to determine their properties, and the results are shown in Table 2.

As is clear from the results of Table 2, the knitted fabrics each produced from the false twisted yarn of the present invention were superior in bulkiness, had bulky feeling even after laundering, and were superior in shape retention. The knitted fabrics further gave bulging a feeling when touched and had a reposeful luster similar to silk luster.

Industrial Applicability

The bulky false twisted yarn of the present invention is superior in high durability and recoverability of bulkiness, as well as in crimp shape retention under wet conditions during dyeing, laundering, etc., and is very useful in the textile industry and the clothing industry.

TABLE 1

| | Spinning conditions | | | Physical properties | |
|---|---|---|---|---|---|
| | Nozzle diameter × nozzle number (μm × number) | Linear speed of discharging (m/min) | Draft ratio (times) | Tenacity as dried (g/d) | Elongation as dried (%) |
| Test yarn | 110 × 50 | 60 | 5.5 | 4.0 | 7.5 |

TABLE 2

| | Properties of false twisted yarn | | | Thickness of knitted fabric (mm) | |
|---|---|---|---|---|---|
| | Crimp extension (%) | Number of crimps (number/in.) | Crimp shape coefficient | Before laundering (w*** = 0) | After laundering (w = 5) |
| Example 1 | 0.7 | 35 | 0.02 | 0.072 | 0.065 |
| Example 2 | 3.2 | 40 | 0.08 | 0.082 | 0.070 |
| Example 3 | 5.4 | 45 | 0.12 | 0.095 | 0.081 |
| Comparative Example 1 | 0.47 | 32 | 0.015 | 0.043 | 0.025 |
| Comparative Example 2 | 11.0 | 50 | 0.22 | 0.098 | 0.090 |
| Comparative Example 3 | 3.2 | 40 | 0.08 | 0.078 | 0.027 |
| Comparative Example 4 | 5.4 | 45 | 0.12 | 0.082 | 0.031 |

| Stretch recovery (%) | | Hand feel of knitted fabric | | Appearance of knitted fabric | Degree of swelling in water |
|---|---|---|---|---|---|
| w = 0 | w = 5 | w = 0 | w = 5 | (w = 0) | (%) |
| 86 | 83 | ○ | ○ | ○ | 65 |
| 85 | 83 | ○ | ○ | ○ | 65 |
| 83 | 80 | ○ | ○ | ○ | 65 |
| 92 | 90 | X | X | ○ | 65 |
| 83 | 81 | X | X** | X | 65 |
| 96 | * | ○ | X** | ○ | 90 |
| 93 | * | ○ | X** | ○ | 90 |

*The crimp extended to the full length and measurement was impossible.
**Feeling was hard.
***The number of washing treatments.

We claim:

1. A false twisted yarn comprising a lyocell multifilament yarn having a crimp shape coefficient defined by CE/N of 0.02–0.20, wherein CE is a crimp extension and N is the number of crimps; a crimp extension of 0.7–7%; and a degree of swelling in water of 70% or less.

2. A false twisted yarn according to claim 1, wherein the crimp shape coefficient is 0.05–0.12.

3. A false twisted yarn according to claim 1, wherein the crimp extension is 1.0–5.0%.

4. A false twisted yarn according to claim 1, wherein the degree of swelling in water is 40–70%.

* * * * *